United States Patent [19]

Tareau

[11] 3,979,801

[45] Sept. 14, 1976

[54] FASTENING DEVICE TO BE USED FOR DOING-UP A BRASSIERE

[76] Inventor: Georges Tareau, 123, rue La Fayette, Paris 10e, France

[22] Filed: Mar. 13, 1975

[21] Appl. No.: 557,918

[30] Foreign Application Priority Data

Nov. 15, 1974 France ..... 74.37818

[52] U.S. Cl. ..... 24/201 BN; 24/230 BC

[51] Int. Cl.[2] ..... A44B 21/00

[58] Field of Search ..... 24/230 SL, 201 S, 201 BN, 24/201 CF, 21, 75, 230 BC, 10 R

[56] References Cited

UNITED STATES PATENTS

| | | | |
|---|---|---|---|
| 302,421 | 7/1884 | Mosier | 24/230 BC X |
| 796,414 | 8/1905 | Chayes | 24/75 |
| 879,282 | 2/1908 | Mandeville | 24/230 BC |
| 1,622,770 | 3/1927 | Coombs | 24/230 BC UX |
| 1,759,550 | 5/1930 | Friedlander | 24/230 BC |
| 2,956,324 | 10/1960 | Klein | 24/230 BC |
| 3,080,635 | 3/1963 | Gunther et al. | 24/230 BC |

FOREIGN PATENTS OR APPLICATIONS

| | | | |
|---|---|---|---|
| 943,056 | 9/1948 | France | 24/230 BC |
| 1,047,398 | 7/1953 | France | 24/230 BC |
| 222,836 | 6/1910 | Germany | 24/201 S |
| 1,138,122 | 12/1968 | United Kingdom | 24/201 BN |

*Primary Examiner*—Donald A. Griffin
*Attorney, Agent, or Firm*—Hauke & Patalidis

[57] ABSTRACT

The fastening device comprises two elements, one with a female part and the other one with a male part provided to penetrate into the female part for doing-up a brassiere which is connected to a ring portion of each of the two elements of the fastening device.

2 Claims, 7 Drawing Figures

FASTENING DEVICE TO BE USED FOR DOING-UP A BRASSIERE

BACKGROUND OF THE INVENTION

The present invention relates to a fastener enabling to do up a brassiere, either in the middle of the back of a woman, as usual, or between the two brassiere cups.

The up-to-now known devices to do up brassieres either in the middle of the back or between the two brassiere cups, are not practical and besides, they are of a difficult manufacture, which means an expensive manufacture.

The present invention copes with these disadvantages by creating a fastener which is simple, cheap and prevents any annoyance to the user.

SUMMARY OF THE INVENTION

According to the invention, the fastening device is constituted by two elements, one of said two elements comprises at least a recess and the second one of said two elements comprises at least a solid volume penetrating into the recess upon fastening the device, each of said two elements comprising in addition an element to be joined to a given portion of the brassiere.

These and other objects and advantages of the invention will become more apparent from the following detailed description when taken in conjunction with the accompanying drawings.

DETAILED DESCRIPTION OF THE PREFERRED EMBODIMENTS

Figure 1:
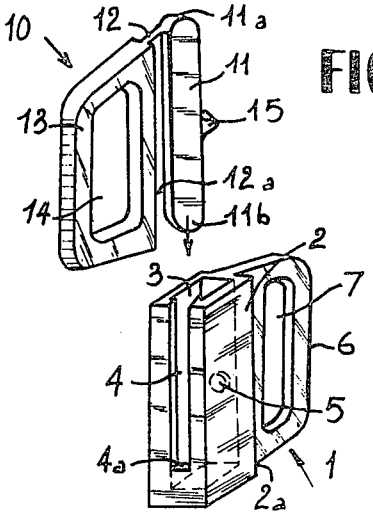
FIG. 1 is a perspective view of a first embodiment of the fastener.

Referring now to the drawings, FIG. 1 shows a fastener for brassiere which comprises a female portion 1 and a male portion 10. The female portion 1 is constituted by a substantially parallelepipedic element 2 hollowed by a longitudinal cavity 3.

A slot 4 is designed in the front side of the parallelepipedic element 2, said slot 4 ending just before the bottom of the cavity 3. Besides, there has been made, substantially in the middle of the rear side of the cavity 3, a hole 5 of which the purpose will be explained hereinbelow.

The parallelepipedic element 2 is extended on its rear side 2*a* by a ring 6 of which the cavity 7 enables a connection of the female element 1 to a portion of the brassiere, either between the two brassiere cups or to the band, either elastic or not, placed in the back of the user.

The male element 10 comprises a small bar 11, parallelepipedic in shape, having sizes slightly smaller than the inner sizes of cavity 3.

Upper and lower edges 11*a*, 11*b* of the small bar 11 are rounded, while a thin plane portion 12 connects the front side of the element 11 to a ring 13 of which the cavity 14 enables to fix the male element 10 to an other portion of the brassiere. A lug 15 protrudes substantially in the middle of the rear side of the small bar 11.

When the fastener of FIG. 1 is correctly mounted either between the two cups of a brassiere, or on the band placed in the back of the user, the doing-up of the brassiere is simply made by making the small bar 11 of the male element 10 to penetrate into the cavity 3 of the female element 1. Then, on one hand the lug 15 penetrates into the hole 5 and, on the other hand, the lower part 12*a* of the thin plane portion 12 bears on the bottom 4*a* of the slot 4 thus ensuring a correct holding of the brassiere.

In some cases the recessed hole 5 and lug 15 can be differently placed.

Figure 1A:
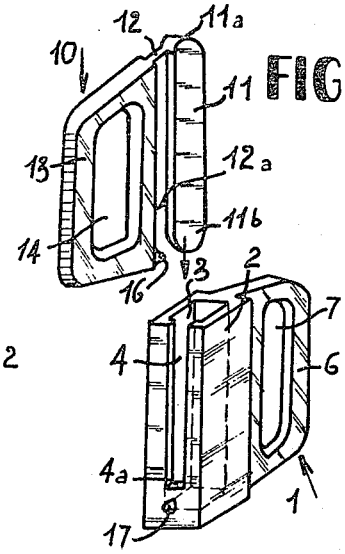
FIG. 1A shows a variant of a part of the fastener.

In the variant of FIG. 1A the lower portion of the ring 13 of the male portion 10 has a lug 16 while the female portion 1 has, at the lower portion of the parallelepipedic element 2, also a lug 17.

When the male element 11 is forced into the female element 1, the lug 16 comes to abut on the lug 17 then, while increasing the pressure, the lug 16 passes beneath the lug 17 whereby everything is locked. Instead of using two protruding lugs such as 16 and 17, it is also possible to use only one lug made in one element while the other element is provided with a hole. In this latter case, locking is quite similar to that of FIG. 1 with the lug entering the hole.

To separate the element 1 from the element 10, it is only necessary to apply a pressure in a direction opposite to that indicated by an arrow represented at the bottom of the male element (FIGS. 1–1A).

Figure 2:
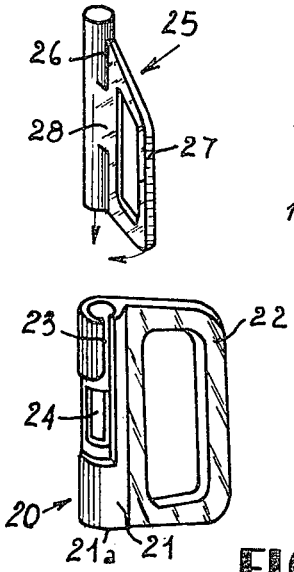
FIG. 2 is a perspective view of a variant of embodiment of the fastener.

In FIG. 2, the female element 20 is constituted by a tube 21 which can either be closed or not at its lower portion 21*a*. The tube 21 is fixed on a ring 22 designed to connect the fastener to the brassiere and comprises a lateral slot 23 leading to a recess 24 placed on the front side of the tube 21.

The male element 25 comprises a solid cylinder 26 connected to a ring 27 for the fixing to the brassiere through a small plane portion 28 of a height slightly higher than that of the recess 24.

As in the previous case, when it is desired to do-up the brassiere, it is only necessary to make the cylinder 26 to penetrate into the tube 21 while sliding the small plane portion 28 into the slot 23, then a rotation through 90° of the male element 25 with respect to the female element 20 locks the fastener since the small plane portion 28 is maintained between the high and low portions of the recess 24.

Figure 3:
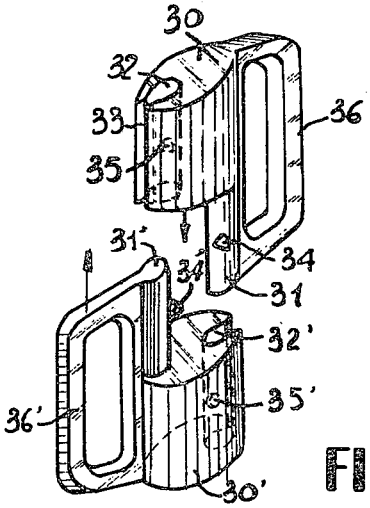
FIG. 3 is a perspective view of a further variant of the fastener.

In FIG. 3, the two elements are respectively similar and are each constituted by a cylinder 30, of a rather important size, extended by a much smaller cylinder 31.

The height of the cylinder 30, which is equal to that of the small cylinder 31, comprises a circular recess 32 extended by a slot 33.

The cylinder 31 comprises a locking lug 34 placed substantially at half-height of the cylinder.

It is to be noted that in the hollow portion 32 of the cylinder 30, there is a recessed hole 35 placed substantially at half-height of the hollowed portion.

Finally a ring 36 enables a connection of the cylinders 30 and 31 with the brassiere as already described.

In the other element, which is symmetrical and similar to the first one, the corresponding parts have the same references with a prime index. To connect the two elements, the cylinders 31 and 31' are respectively introduced into the circular recesses 32, 32', locking being made by penetration of the lugs 34, 34' into the holes 35, 35'.

Figure 4:
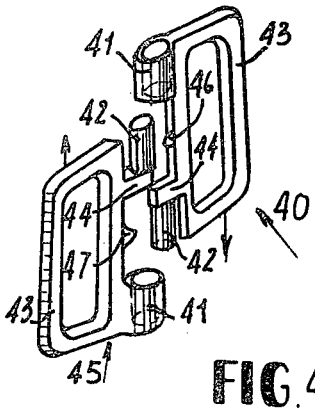
FIG. 4 is a perspective view of a still further variant of the fastener.

In FIG. 4, the two elements 40, 45 are also respectively identical and symmetrical and are each constituted with a small tube 41 and a finger 42, each small tube 41 being connected to the ring 43 used for fixing the fastener to the brassiere while the fingers 42 are connected to a thin plane portion 44 of a triangular shape and made through moulding with the rings 43.

There has been provided, in the right hand element (FIG. 4), a hole 46 and in the left hand element, a lock forming lug 47.

Connection of the two elements of this fastener is similar to that described in reference with FIG. 3.

Figure 5:
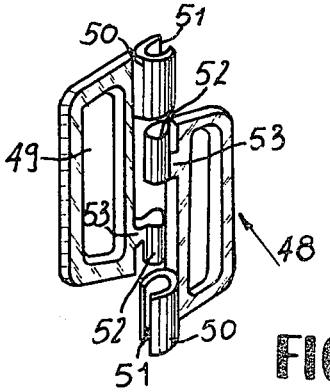
FIG. 5 is a perspective view of another embodiment of the fastener.

In FIG. 5, each ring 48, 49 enabling to fix the fastener on the brassiere is provided, at one end thereof, with a tube 50 opened by a cut 51.

The other end of each ring 48, 49 is provided with a cylinder 52 connected to said ring by a thin plane portion or small tongue 53.

The fastening of this device is made through the penetration of the small cylinders 52 into the tubes 50.

In such a case also, one of the tubes 50 can comprise a recessed hole and one of the cylinders 52 can comprise a locking lug.

Figure 6:
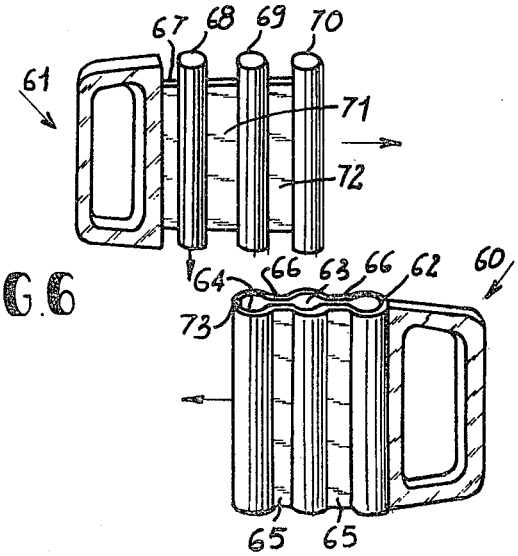
FIG. 6 is a perspective view of still another embodiment of the fastener comprising an adjusting element of the tension of the lower portion of the brassiere.

In FIG. 6, rings 60, 61 are provided for fixing the fastener to the brassiere. The ring 60 is connected to a plurality of tubes 62, 63, 64, said tubes being respectively connected together by walls 65, 66 while the ring 61 supports, through a thin plane portion 67, a same plurality of cylinders 68, 69, 70 respectively connected together by thin plane portions 71, 72.

For fixing the brassiere, it suffices to engage the cylinders 69, 70 in the interval delimited by the tubes 62, 63, 64 and the walls 65, 66.

A longitudinal slot 73 is obviously provided in the portion of the tube 64 opposite the fixing ring 60 to enable penetration of the male element into the female portion. It is then possible to enter the cylinder 70 either in the tube 62 or the tube 63 or still in the tube 64 and then adjust the tension of the lower portion of the brassiere provided with the fastening device of the invention.

The various parts represented in FIGS. 1 – 6 are generally obtained through a moulding process but they can also be formed by other process.

I claim:

1. Fastening device for a brassiere and the like consisting of two elements, one of said two elements comprising at least a recess and the other of said two elements comprising at least a solid volume for penetrating into the recess upon fastening the device, each of said two elements further comprising an integral connecting ring attached to a portion of the brassiere and the like, wherein said rings are of the same size, the first of said elements is in the form of a hollow volume having a longitudinal slot of a length less than the depth of the recess receiving the solid volume of the second one of the two elements, said solid volume having a size slightly smaller than that of the recess and being connected to its corresponding connecting ring by a thin plane portion, said thin plane portion being engageable in said slot and having a height enabling said solid volume to be engaged in the recess of the hollow volume, and locking means integral with said solid volume and said hollow volume respectively for releasably holding said solid volume in said hollow volume, wherein the longitudinal axes of said elements are disposed substantially normal to any pull exerted by the fastened portions of said brassiere and the like, wherein said two elements are respectively identical and symmetrical, each of said two elements comprising a male and female element enabling junction of two portions of the brassiere.

2. Fastening device as set forth in claim 1, wherein each of said two elements comprises a solid cylindrical male portion at one end of the element and a hollow cylinder at an other end of the element, whereby the cylindrical male portion of one of said two elements is engageable into the hollow cylinder of the second one of said two elements.

* * * * *